US005407097A

United States Patent [19]

Harpold

[11] Patent Number: 5,407,097

[45] Date of Patent: Apr. 18, 1995

[54] METHOD AND APPARATUS FOR HANDLING PRINTING INK

[75] Inventor: Charles W. Harpold, Grand Rapids, Mich.

[73] Assignee: Harco Graphic Products, Inc., Grand Rapids, Mich.

[21] Appl. No.: 124,956

[22] Filed: Sep. 21, 1993

[51] Int. Cl.[6] ..... B67B 7/00

[52] U.S. Cl. ..... 222/1; 222/238; 222/325; 222/643

[58] Field of Search ..... 222/1, 158, 238, 333, 222/309, 325, 638, 642, 643

[56] References Cited

U.S. PATENT DOCUMENTS

| | | | |
|---|---|---|---|
| 940,060 | 11/1909 | Ranney . | |
| 1,076,066 | 10/1913 | Runnels . | |
| 3,002,599 | 10/1961 | Lopata | 222/643 X |
| 3,685,085 | 8/1972 | Jaffa . | |
| 4,175,489 | 11/1979 | Gattus . | |
| 4,189,071 | 2/1980 | West | 222/238 X |
| 4,355,734 | 10/1982 | Moore . | |
| 4,817,523 | 4/1989 | Harpold et al. . | |
| 4,978,042 | 12/1990 | Fidler | 222/642 |
| 5,170,710 | 12/1992 | Harpold et al. . | |

*Primary Examiner*—Gregory L. Huson
*Attorney, Agent, or Firm*—Price, Heneveld, Cooper, Dewitt & Litton

[57] ABSTRACT

An ink handling apparatus includes an ink handling module and a base for receiving and supporting the ink handling module. The ink handling module includes a container having a discharge aperture, a moveable member with paddles for moving ink through the discharge aperture, and an ink pump connected to the discharge aperture for receiving and pumping the discharged ink through a supply hose to a desired location. The base includes a pair of motors each having releasably engageable drive connectors for releasably engaging drives on the moveable member and the ink pump. The releasable engageable drive connectors are configured so that the ink handling module can be set on the base with the releasably engageable drive connectors engaged with the drives, whereafter interlocking connectors on the base and the ink handling module can be fastened to secure the assembly together. The base further includes a control circuit for the motors, the control circuit including a timed pump actuation circuit, a manually actuated motor circuit, and a continuously actuated motor circuit.

24 Claims, 5 Drawing Sheets

METHOD AND APPARATUS FOR HANDLING PRINTING INK

BACKGROUND OF THE INVENTION

The present invention relates to ink handling apparatus, and in particular concerns an ink handling apparatus having features which facilitate quick change of ink.

An ink handling device is disclosed in U.S. Pat. No. 5,170,710 issued Dec. 15, 1992 to Harpold et al. entitled "METHOD AND APPARATUS FOR HANDLING PRINTING INK". This ink handling device works well, however the device requires significant capital expenditure and is thus more satisfactory for large ink volume users rather than for lower ink volume users, particularly where frequent changes in ink color are required or where there are a large number of ink colors/ink types that must be periodically or intermittently supplied. Further, it is desirable to improve the compactness of the unit so that the unit can be used easily and efficiently in small areas.

SUMMARY OF THE INVENTION

The present invention includes an ink handling apparatus for supplying ink having an ink handling module and a base configured to releasably receive the ink handling module. The ink handling module includes a container for holding ink, an ink pump in fluid communication with the container, and an ink moving member configured to move ink in the container toward the pump so that the pump does not cavitate. The base includes at least one motor and a circuit for controlling the motor, the at least one motor being configured to releasably engage a drive on the ink pump and a drive on the ink moving member when the ink handling module is received on the base. This allows the ink handling module to be easily replaced by another ink handling module such as to facilitate a change in inks or for repair.

These and other features and advantages of the present invention will be further understood and appreciated by those skilled in the art by reference to the following specification, claims and appended drawings.

DETAILED DESCRIPTION OF THE PREFERRED EMBODIMENT

Figure 1:
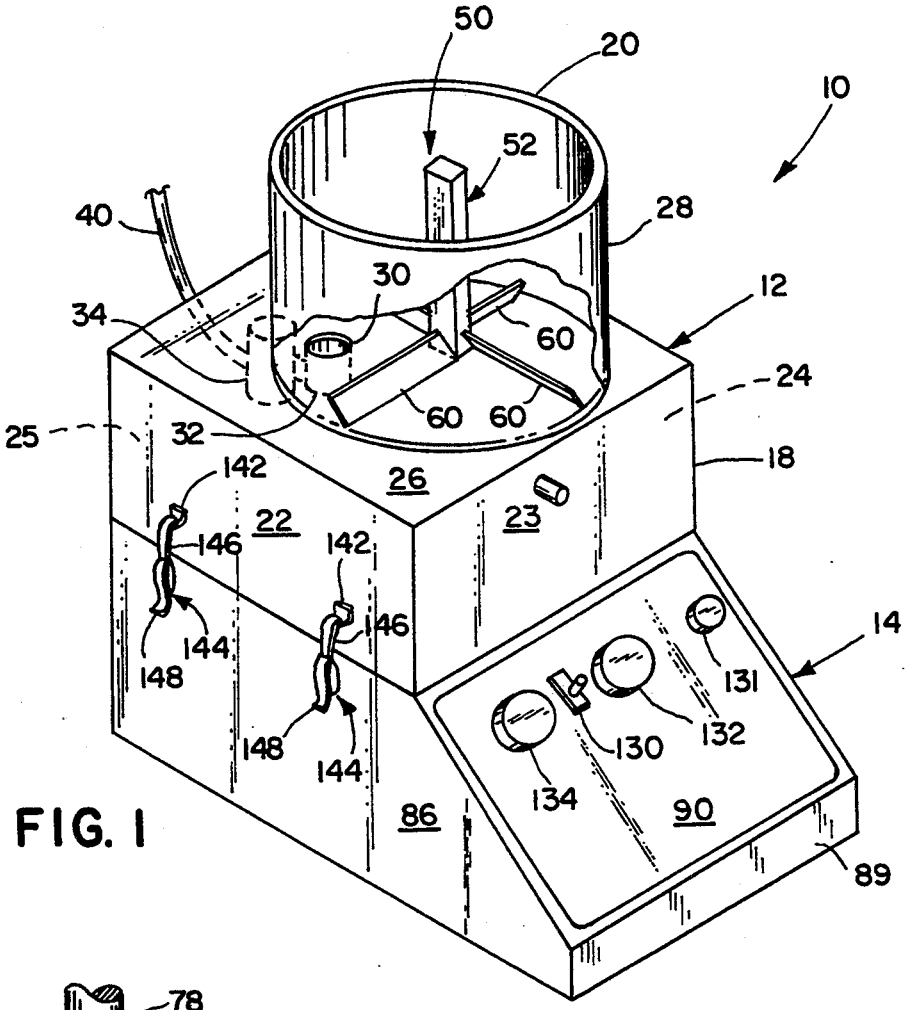
FIG. 1 is a perspective view of an ink handling apparatus embodying the present invention.
Figure 9:
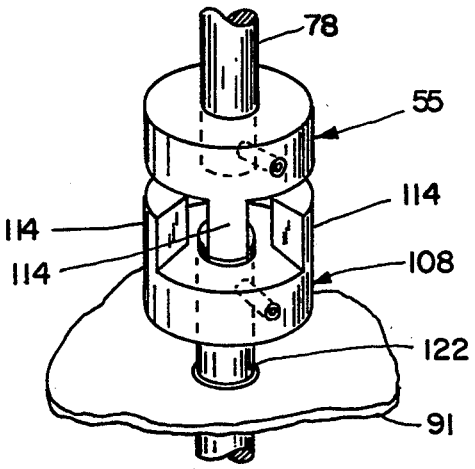
FIG. 9 is an enlarged perspective view of, the releasably engageable connectors used for connecting the motors to the drives of the paddle subassembly and the gear pump.

An ink handling apparatus 10 (FIGS. 1 and 2) embodying the present invention includes an ink handling module 12 for holding and supplying ink, and a base 14 configured to releasably receive the ink handling module 12 in a manner that allows base 14 to power module 12. Since ink is handled only by ink handling module 12, ink colors can be quickly and easily changed by removing a first ink handling module 712 and by replacing it with another ink handling module 12.

Ink handling module 12 (FIG. 2) includes a box-shaped housing 18 and a container 20 for holding ink, the container 20 being secured to the top of housing 18. Housing 18 includes sides 22–25 and a top 26, with the bottom being left open. Container 20 includes a cylindrically-shaped sidewall 28, the bottom of container 20 being formed by the top 26 of housing 18. A discharge aperture 30 (FIG. 3) is formed in container bottom/-housing top 26. A reservoir 32 is secured under discharge aperture 30. An ink pump 34 is secured to housing top 26 adjacent reservoir 32, ink pump 34 including an inlet 36 operably connected to and in fluid communication with reservoir 32, and further including an outlet 38 connected to an ink supply hose 40. Notably, ink supply hose 40 can be routed to a number of different locations, such as an automatic printing press (not shown) which requires periodic additional amounts of ink. Ink supply hose 40 can also be routed back into container 20, such as when mixing of the ink is desired. Ink pump 34 is preferably a positive displacement gear-type pump which not only positively moves ink forwardly into ink supply hose 40, but also provides some grinding and mixing of the ink during delivery. If hose 40 is positioned to drop ink back into container 20, ink is repeatedly passed through pump 34 which causes repeated grinding of the ink for providing a more uniform mix. Ink pump 34 further includes a downwardly extending drive 42 having a releasably engageable drive connector 44 on its free end.

Figure 8:
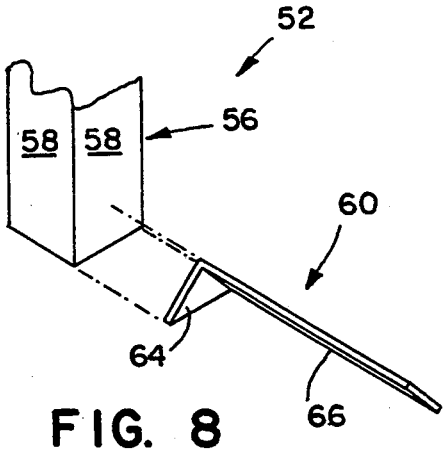
FIG. 8 is a fragmentary exploded perspective view of the center post and a paddle of the paddle subassembly shown in FIG. 6.
Figure 6:
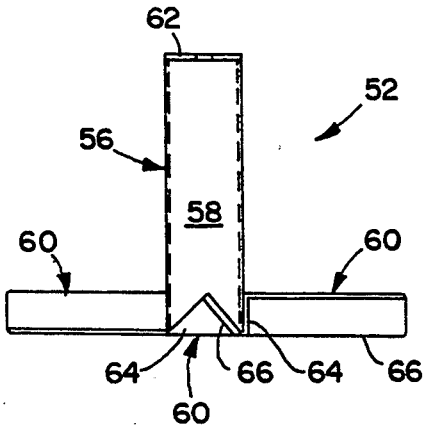
FIG. 6 is a side view of the paddle subassembly.
Figure 7:
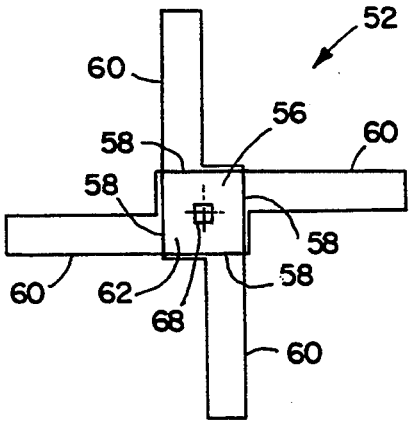
FIG. 7 is a top view of the paddle subassembly.

An ink moving member 50 (FIG. 3) is movably positioned in container 30 of ink handling module 12. Ink moving member 50 includes a paddle subassembly 52 and a drive 54 connected to paddle subassembly 52, drive 54 including a drive connector 55. Paddle subassembly 52 (FIGS. 6–8) includes a square hollow post 56 with flat side surfaces 58. Paddles 60 are attached to each of sides 58 at a lower end thereof. A lop plate 62 closes off the top of square hollow post 56 and further provides a driving function as noted below.

Paddles 60 (FIG. 8) each include a triangularly-shaped attachment tab 64 at one end, and an elongated inclined ink engaging panel 66. Tab 64 is welded or otherwise secured to post side 58 so that paddle panel 66 moves ink around container 20 as post 56 is rotated. Paddle panel 66 is oriented at about 45° to container bottom 26 so that the ink is also urged downwardly as paddles 60 are moved. Thus, as paddles 60 pass discharge aperture 30, ink is urged through discharge aperture 30 into reservoir 32. This prevents ink pump 34 from cavitating since a continuous supply of ink is provided, even if the ink is non-flowing viscous ink such as plastisol ink. Hollow post 56 extends upwardly slightly short of the top of container 20. Top plate 62 on hollow post 56 includes a square aperture 68.

Drive 54 (FIG. 3) includes a drive tube 70 that extends sealingly through container bottom/housing top 26. A plug 72 fills the top of tube 70 and includes a threaded hole 74. A screw 76 extends through top plate square aperture 68 securely into threaded hole 74. Screw 76 includes a square section on its head to securely engage square aperture 68. Drive 54 is rotated clockwise when viewed from above so that the threads of screw 76 naturally tend to tighten in threaded hole 74 rather than loosen. A shaft 78 is welded to the lower end of drive tube 70. Shaft 78 has the releasably engageable drive connector 55 secured at its lower end, drive connector 55 being positioned at about the stone height as ink pump drive connector 44.

Base 14 (FIG. 2) includes a housing 84 having sides 86 and 87, a back 88, a square front 89, an angled front 90, and a top 91. An ink-pump-driving motor 94 (FIG. 3) and an ink-moving-member-driving motor 96 are secured under base top 91. Motor cooling fans 98 and 100 are attached to and cool motors 94 and 96, respectively. Speed reduction devices 102 and 104 are secured to motors 94 and 96 respectively. Speed reduction devices 102 and 104 include an output shaft having drive engaging connectors 106 and 108, respectively, that protrude upwardly above base top 91. Drive engaging connectors 106 and 108 are spaced apart and otherwise positioned so that they mateably engage pump drive 42 and paddle subassembly drive 54 when ink handling module 12 is positioned on base 14.

Figure 10:
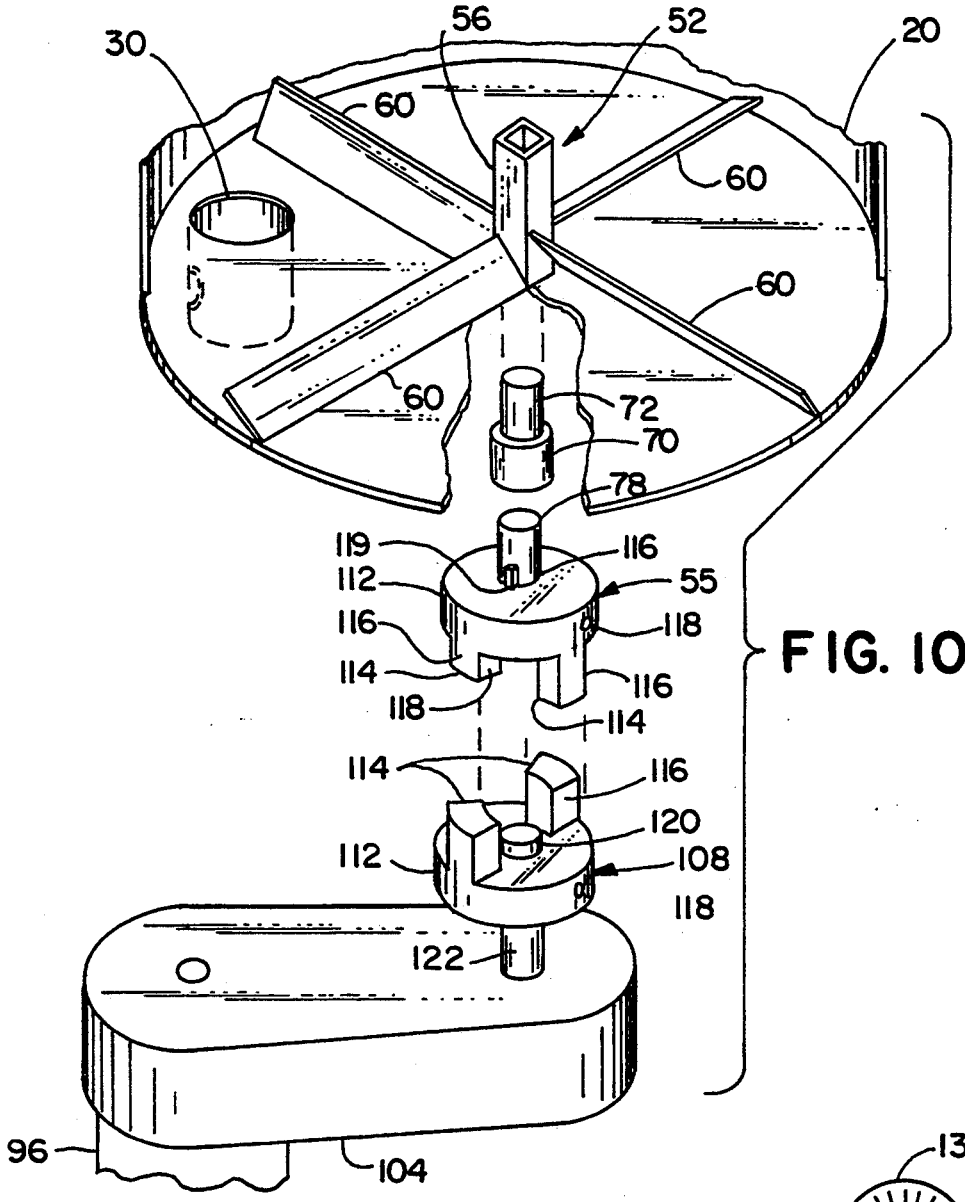
FIG. 10 is a partial broken-away exploded perspective view of the drive arrangement used on the paddle subassembly.

The preferred embodiment connectors 106, 108, 44 and 55 are comparable in shape. Thus, to reduce redundant discussion, only the connectors 108 and 55 will be described hereinafter. Connectors 108 and 55 (FIG. 10) each include a disc-shaped bottom 112 with a pair of spaced apart opposing fingers 114 protruding axially from disc-shaped bottom 112. Disc-shaped bottom 112 includes a centered hole 116 for receiving shaft 78 of paddle subassembly 52, and a transversely oriented set screw 118 and axially extending key 119 for engaging shaft 78 when positioned therein. Fingers 114 are spaced apart and project so that they interlockingly engage at finger side surfaces 116 when connectors 108 and 55 are positioned proximate each other. Preferably, the tips of fingers 114 are configured with a slight incline or have a limited width so that they can be easily engaged by axial movement as the ink handling module 12 is placed on base 14. Fingers 114 of connector 55 also include an inner surface 118 that engages the tip 120 of output shaft 122 extending upwardly from speed reduction device 104. Notably, fingers 114 of connector 108 include a comparable surface to connector 55 for engaging the lower end of the drive shaft 78.

Figure 2:
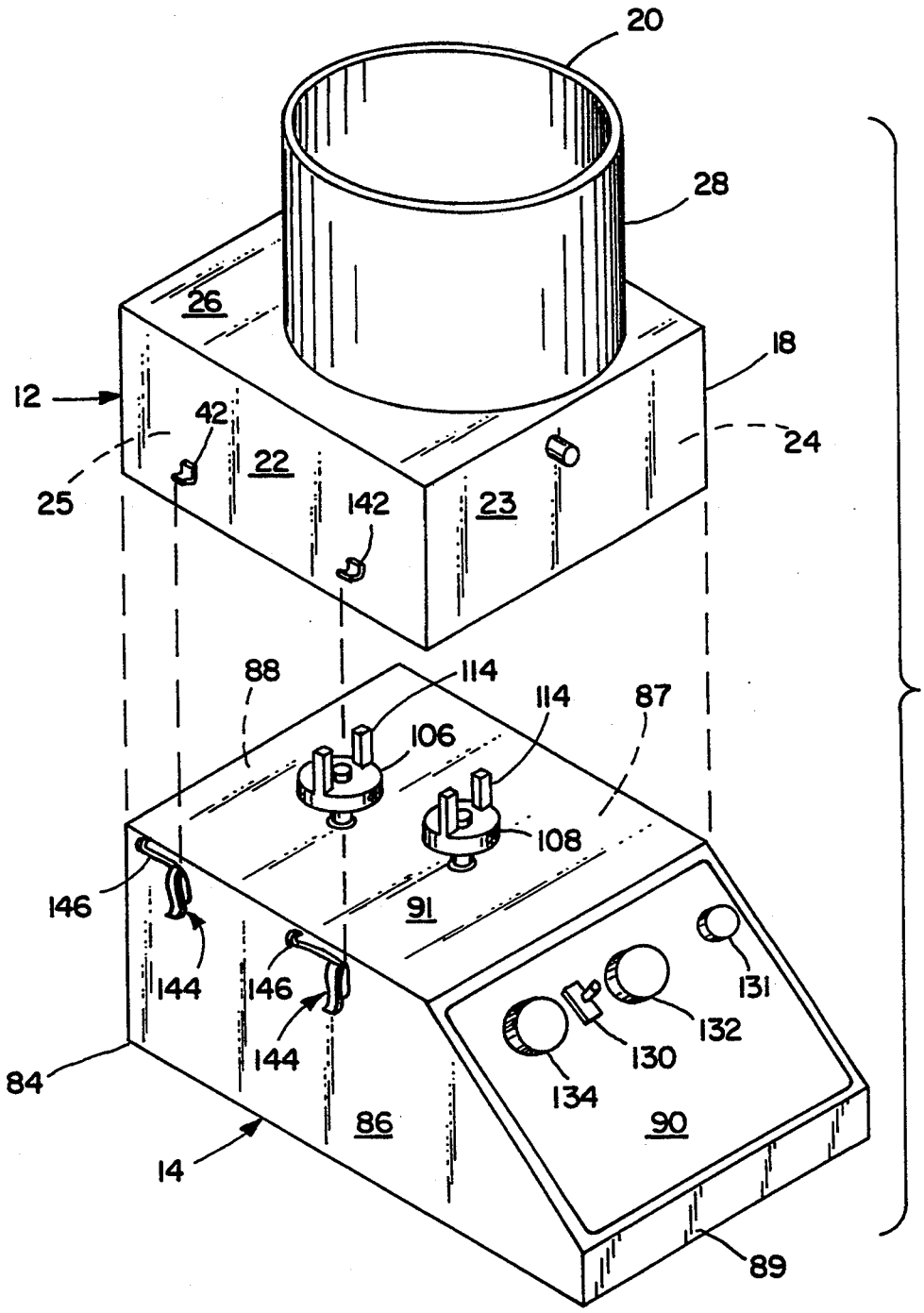
FIG. 2 is an exploded view of the ink handling apparatus shown in FIG. 1.
Figure 4:
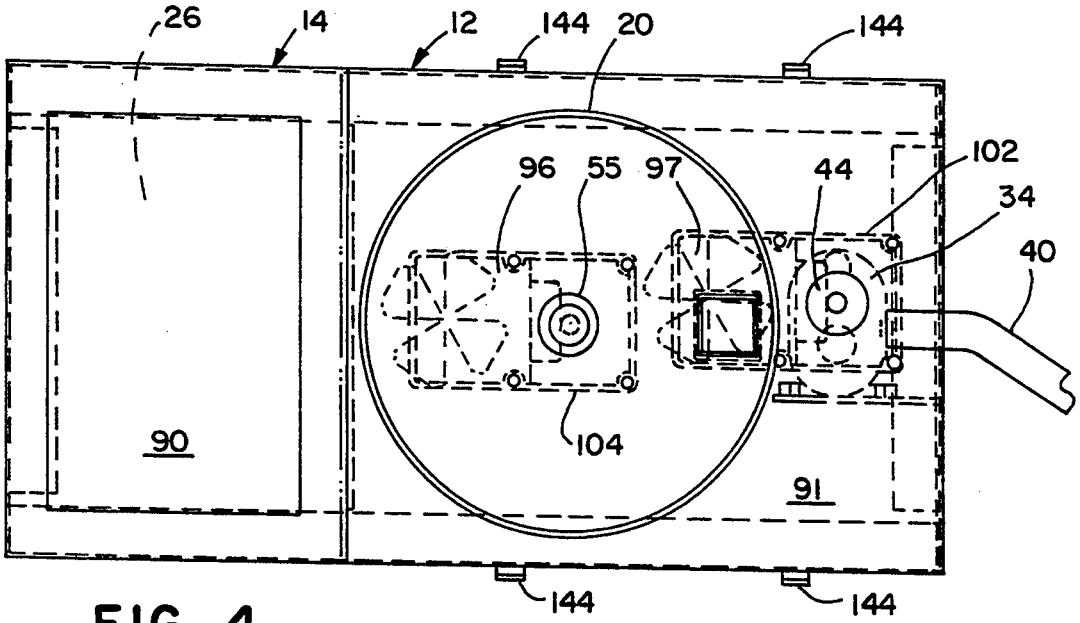
FIG. 4 is a top view of the ink handling apparatus shown in FIG. 1, the paddle assembly having been removed for clarity.

Ink handling module 12 is configured to mateably rest on the top of base 14 and is releasably held on base 14 by a pair of connectors 144 (FIGS. 1 and 2). In the installed position, ink handling module sides 22–25 rest on and mateably engage base top 91. A pair of fingers 142 extend outwardly from opposing sides of ink handling module sides 22 and 24. The pair of toggle-type connectors 144 are positioned on base sides 86 and 87 corresponding below fingers 142. Toggle-type connectors 144 include an upwardly extending hook-shaped member 146 for grabbing fingers 142, and further include a handle 148 that is moveable to an overcenter locking position so that ink handling module 12 can be securely held to base 14. By securing ink handling module 12 to base 14 with toggle-type connectors 144, connectors 106 and 44 and also 108 and 55 are securely held in engagement. Contrastingly, by releasing connectors 144, ink handling module can be easily removed and replaced with another ink handling module. This makes changing inks a very easy and clean process. Further, capital expenditure is greatly reduced since only a single base 14 need be purchased for each operation requiring ink. Of course, as many ink handling modules 12 are purchased as needed to service the multiple inks being used, however the expense is greatly minimized since ink handling modules 12 do not include any expensive electrical motor or controls.

Figure 3:
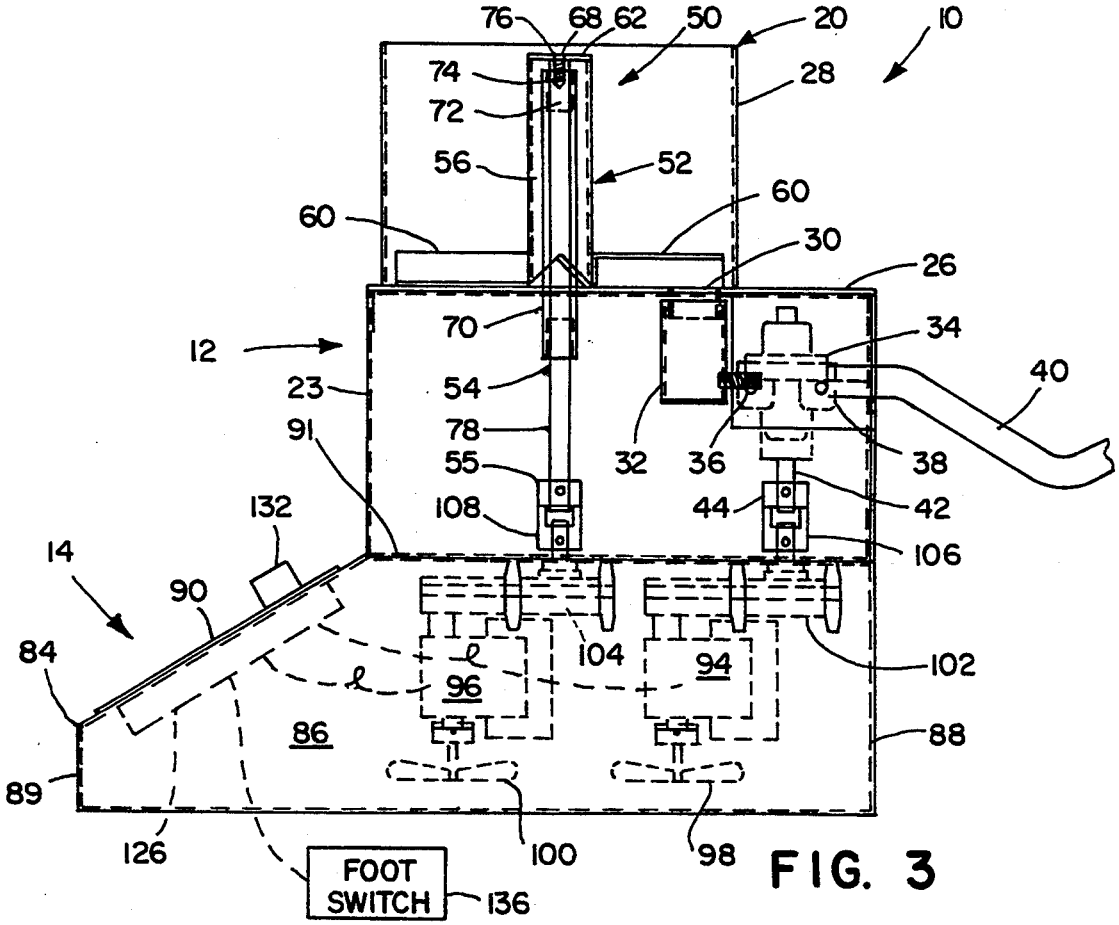
FIG. 3 is a side view of the ink handling apparatus shown in FIG. 1.
Figure 5:
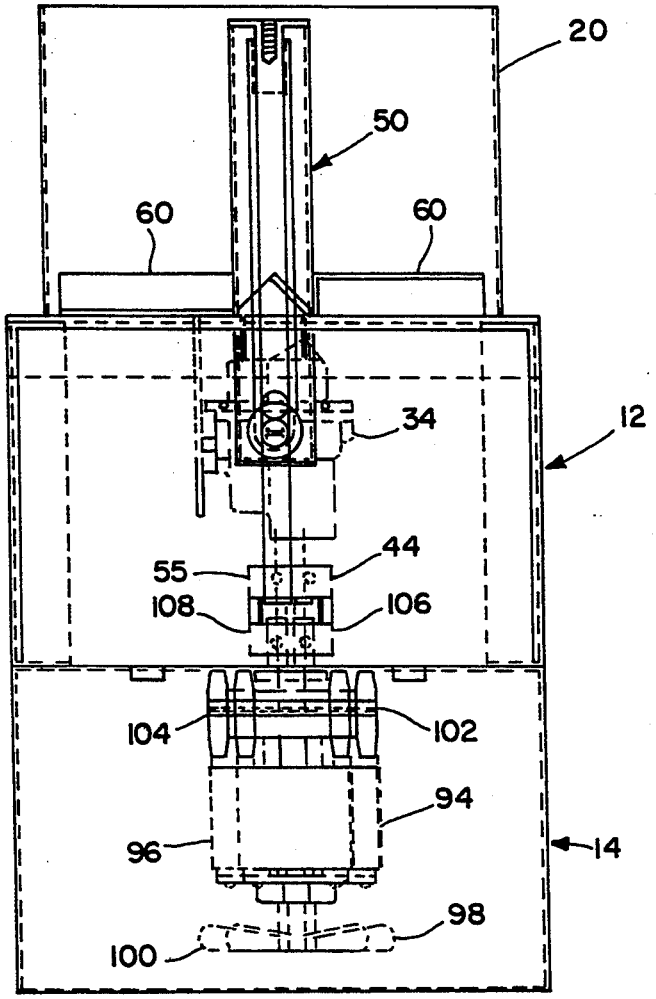
FIG. 5 is a rear elevational view of the ink handling apparatus shown in FIG. 1.
Figure 11:
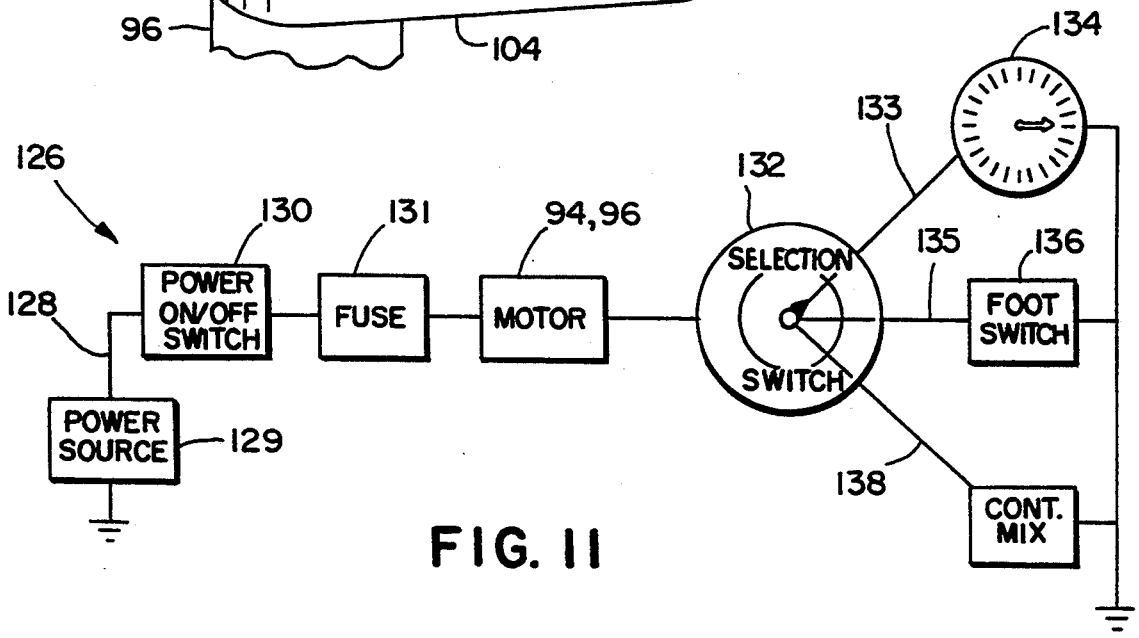
FIG. 11 is an electrical schematic of the motor control circuit.

A motor control circuit 126 is attached to the underside of angled front 90 of base 14 (FIG. 3). Motor control circuit 126 (FIG. 11) includes a power cable 128 connected to a 110 VAC power source 129. Electrical power is communicated through power on/off switch 130 and fuse 131 to motors 94 and 96, respectively. Power is then communicated from motors 94 and 96 to selection switch 132. Selection switch 132 allows manual selection of 1) a timed circuit branch 133 including timer 134 for regular periodic actuation of motors 94 and 96, 2) a manually operated circuit branch 135 including a foot switch 136 which allows manual (irregular) actuation of motors 94 and 96, and 3) a circuit branch 138 that provides continuous actuation of motors 94 and 96. Each of branches 133, 135 and 138 are connected to ground thus completing the circuit. Notably, the illustrated control circuit 126 is for purposes of illustration only, and the invention is contemplated to include a number of different control circuits that can be used to achieve a comparable result.

Having described the components and interrelationship thereof, the operation of apparatus 20 will become apparent to a person of ordinary skill in the art. In operation, ink (not shown) is placed within container 20, and ink handling module 12 is placed securely on base 14 with connectors 144 securely retaining module 12 to base 14. Motor control circuit 126 is energized by connection of the circuit to a power source and by flipping on/off switch 130 to the "on" position. Presuming that the selection switch 132 is turned to the timed circuit branch, motors 94 and 96 are powered periodically for a given amount of time as determined by the setting on timer 134. As motor 94 turns, connectors 44 and 106 engage, causing ink pump 34 to move and pump ink. At the same time, motor 96 causes connector 55 to engage connector 108 thus driving ink moving member 50 including paddle assembly 52. This causes paddles 60 to move in a circular pattern around container 20. Due to the orientation of paddles 60, ink is pushed around within container 20 and also urged downwardly through discharge aperture 30 in container bottom/housing top 26. This causes a continuous supply of ink to be delivered to pump 34 so that pump 34 does not cavitate. Thus, ink is continuously pumped through supply line 40 to the desired location.

When a new ink is desired, ink handling module 12 can be removed by simply releasing connectors 144 anti lifting away the ink handling module 12. A new ink handling module 12 can then be positioned on base 14 and secured in place by connectors 144. The entire ink changing sequence takes only a few seconds, and is very clean. This is important, since the printing industry is very competitive and since inks are known to be very messy. Further, capital expenditure is minimized.

In the foregoing description, it will be readily appreciated by those skilled in the art that modifications may be made to the invention within departing from the concepts disclosed herein. Such modifications are to be considered as included in the following claims, unless these claims by their language expressly state otherwise.

The embodiments of the invention in which an exclusive property or privilege is claimed are defined as follows:

1. An ink handling apparatus for supplying ink, comprising:

an ink handling module including a container for the ink, an ink pump in fluid communication with said container, and an ink moving member configured to move the ink in the container toward said ink pump, one of said ink pump and said ink moving member including drive means; and a base configured to releasably receive said ink handling module including a motor and a circuit for controlling said motor, said motor being configured to releasably engage said drive means and being engaged with said drive means when said ink handling module is received on said base, whereby a given ink handling module can be easily replaced by another ink handling module to facilitate change of inks and repair.

2. An ink handling apparatus as defined in claim 1 wherein said motor comprises a first motor for powering said ink pump and including a second motor for powering said ink moving member.

3. An ink handling apparatus as defined in claim 2 wherein said ink pump and said first motor include mating connectors having releasably engageable interlocking fingers, said mating connectors on said ink pump defining said drive means.

4. An ink handling apparatus as defined in claim 3 including interlocking connectors on said base and said ink handling module for retaining said ink handling module to said base.

5. An ink handling apparatus as defined in claim 4 wherein said container includes a discharge aperture and said ink pump is connected to said discharge aperture and further includes a supply hose extending from said ink pump for supplying ink to a desired location.

6. An ink handling apparatus as defined in claim 5 wherein the circuit for controlling the motors includes a selection switch having at least three selectable positions, a timed circuit branch for providing periodic operation of the motors connected to one of the switch positions, another circuit branch for providing manual operation of the motors connected to another of the switch positions, and yet another circuit branch for providing continuous motor operation connected to yet another of the switch positions.

7. An ink handling apparatus as defined in claim 1 wherein drive means of said ink pump and said motor include mating connectors having releasably engageable interlocking fingers, said mating connectors on said ink pump defining said drive means.

8. An ink handling apparatus as defined in claim 7 including interlocking connectors on said base and said ink handling module for retaining the ink handling module to the base.

9. An ink handling apparatus as defined in claim 1 wherein the container includes a discharge aperture and said ink pump is connected to the discharge aperture, and further including a supply hose extending from said ink pump for supplying ink to a desired location.

10. An ink handling apparatus as defined in claim 1 wherein said circuit for controlling the motor includes a selection switch having at least three selectable positions, a timed circuit branch for providing periodic operation of the motors connected to one of the switch positions, another circuit branch for providing manual operation of the motors connected to another of the switch positions, and yet another circuit branch for providing continuous motor operation connected to yet another of the switch positions.

11. An ink handling apparatus as defined in claim 1 including a plurality of ink handling modules that can be selectively placed on said base.

12. An ink handling apparatus as defined in claim 1 wherein said container includes a discharge aperture, and wherein said ink moving member includes a plurality of paddles oriented at an angle so that the paddles urge ink through a discharge aperture in said container toward said ink pump.

13. An ink handling apparatus as defined in claim 12 wherein said ink moving member includes a tubular post centrally located in said container and extending through the bottom of said container bottom, said post including a first portion located in said container above the container bottom to which said paddles are attached, and further including a second portion located outside said container and including second drive means for driving said ink moving member.

14. An ink handling apparatus for supplying ink comprising:

an ink handling module including a container for ink and an ink pump in fluid communication with said container, said ink pump including a releasably engageable drive; and a base configured to releasably receive said ink handling module including a motor and a circuit for controlling said motor, said motor including a drive connector configured to releasably engage said ink pump drive when said ink handling module is positioned on said base.

15. An ink handling apparatus as defined in claim 14 including an interlocking connector for connecting said ink handling module to said base.

16. An ink handling apparatus as defined in claim 14 including a plurality of said ink handling modules.

17. An ink handling apparatus as defined in claim 14 wherein said releasably engageable drive of said ink pump and said drive connector on said motor include interlocking fingers that engage when said ink handling module is positioned on said base.

18. An ink handling apparatus as defined in claim 14 including paddles for moving ink in said container and means for moving said paddles to urge the ink toward said ink pump.

19. An ink handling apparatus comprising:

an ink handling module including a container for ink and an ink moving member configured to move ink in said container, said ink moving member including a releasably engageable drive; and a base configured to releasably receive said ink handling module including a motor and a circuit for controlling said motor, said motor including a drive connector configured to engage said drive of said ink moving member when said ink handling module is positioned on said base.

20. An ink handling apparatus as defined in claim 19 including an interlocking connector for connecting said ink handling module to said base.

21. An ink handling apparatus as defined in claim 19 including a plurality of said ink handling modules.

22. An ink handling apparatus as defined in claim 19 including an ink pump operably connected to said container and further including paddles for moving ink in said container and means for moving said paddles to urge the ink toward said ink pump.

23. An ink handling apparatus as defined in claim 22 wherein said ink moving member includes a tubular post centrally located in said container and extending through the container bottom, said tubular post including a first portion located in said container to which said paddles are attached, and further including a second portion located outside said container and including said moving member drive.

24. A method for changing ink supplies comprising:

providing an ink handling apparatus including a base and at least first and second detachable ink handling modules configured for attachment to the base, the base including a motor, the ink handling modules each including a container, an ink pump in communication with the container for pumping ink from the container, and paddles movably positioned in the container for continuously urging ink toward the ink pump from the container, one of the ink pump and the paddles including a connector adapted to releasably engage the motor in the base when a selected one of the first and second ink handling modules are attached to the base;

detaching a first ink handling module filled with ink from the base;

selecting a second ink handling module filled with ink; and attaching the second ink handling module to the base.

* * * * *

UNITED STATES PATENT AND TRADEMARK OFFICE

CERTIFICATE OF CORRECTION

PATENT NO. : 5,407,097

DATED : April 18, 1995

INVENTOR(S) : Charles W. Harpold

It is certified that error appears in the above-indentified patent and that said Letters Patent is hereby corrected as shown below:

Column 1, line 65
"of," should be --of--;

Column 2, line 16
"712" should be --12--;

Column 2, line 54
"lop plate" should be --top plate--;

Column 3, line 16
"stone height" should be --same height--;

Column 4, line 61
"anti" should be --and--.

Signed and Sealed this

Twelfth Day of September, 1995

*Attest:*

Bruce Lehman

BRUCE LEHMAN

*Attesting Officer*

*Commissioner of Patents and Trademarks*